United States Patent [19]

Menetrier

[11] Patent Number: 4,750,654

[45] Date of Patent: Jun. 14, 1988

[54] BACK PACK WITH REINFORCED FRONT PANEL

[75] Inventor: Marc Menetrier, Annecy, France

[73] Assignee: SACS Millet SA, Seynod, France

[21] Appl. No.: 51,251

[22] Filed: May 7, 1987

Related U.S. Application Data

[63] Continuation of Ser. No. 810,931, Dec. 19, 1985, abandoned.

[30] Foreign Application Priority Data

Dec. 20, 1984 [FR] France ..... 84 20134

[51] Int. Cl.[4] ..... A45F 3/04

[52] U.S. Cl. ..... 224/211; 224/262; 224/907

[58] Field of Search ..... 224/907, 153, 209, 210, 224/259, 261, 262, 215, 211

[56] References Cited

U.S. PATENT DOCUMENTS 4,420,103 12/1983 Douglass ..... 224/210

FOREIGN PATENT DOCUMENTS 71952 4/1947 Norway ..... 224/210

*Primary Examiner*—Henry J. Recla
*Assistant Examiner*—David Voorhees
*Attorney, Agent, or Firm*—Karl F. Ross; Herbert Dubno; Andrew Wilford

[57] ABSTRACT

A backpack having a front panel normally riding on the back of the wearer according to this invention has a front panel which is vertically elongated and which is formed of an at least semirigid shell having a shape generally complementary to that of the back of the wearer and constucted to be relatively bendable longitudinally and relatively stiff transversely. Thus the panel can bend forward and back, that is about a horizontal axis, but cannot flex about a vertical axis. This is achieved by forming the shell with transverse rigidifying formations so it is longitudinally relatively bendable and transversely relatively stiff. These formations according to this invention are ridges or grooves.

3 Claims, 3 Drawing Sheets

BACK PACK WITH REINFORCED FRONT PANEL

This is a continuation of co-pending application Ser. No. 810,931 filed on Dec. 19, 1985 now abandoned.

FIELD OF THE INVENTION

The present invention relates to a back pack. More particularly this invention concerns such a pack whose front is reinforced.

BACKGROUND OF THE INVENTION

A wholly unreinforced back pack has the advantage of extremely light weight and can be extremely comfortable to wear for highly athletic activities like mountain climbing or cross-country skiing. Nonetheless, if it is not packed extremely carefully it can be a substantial hindrance to the wearer, as a hard object in the pack can bump the wearer's back painfully or the entire pack can be imbalanced and wobble when the wearer is moving rapidly.

A pack with a built in front frame avoids many of these problems and allows substantially more to be carried without difficulty. Such packs are, however, often fairly heavy even when empty. In addition they are not comfortable when the wearer must bend a great deal. An attempt to cure this by making the reinforcement semirigid so it can bend somewhat is a compromise that is often an uncomfortable fit and that swings excessively if the wearer is moving rapidly.

OBJECTS OF THE INVENTION

It is therefore an object of the present invention to provide an improved backpack.

Another object is the provision of such a backpack which overcomes the above-given disadvantages, that is which is comfortable but which can conform to the shape of the wearer's back.

SUMMARY OF THE INVENTION

A backpack having a front panel normally riding on the back of the wearer according to this invention has a front panel which is vertically elongated and which is formed of an at least semirigid shell having a shape generally complementary to that of the back of the wearer and constructed to be relatively bendable longitudinally and relatively stiff transversely. Thus the panel can bend forward and back, that is about a horizontal axis, but cannot flex about a vertical axis. This is achieved by forming the shell with transverse rigidifying formations so it is longitudinally relatively bendable and transversely relatively stiff. These formations according to this invention are ridges or grooves.

According to this invention the shell is a unitary piece of synthetic resin formed with the formations. It need not itself form the front of the pack, but can line it or can have a textile covering that is stitched to or part of the rest of the normally textile pack. In addition for maximum comfort for the wearer the shell has a front face turned toward the back of the wearer and provided with a layer of relatively soft material. This soft material is a cellular synthetic resin and is provided with a textile covering.

The shell can also be a relatively rigid piece of a cellular synthetic resin and have a front face turned toward the back of the wearer and integrally formed and provided with a layer of a relatively soft cellular synthetic resin in turn provided with a textile covering.

For best fit the shell is forwardly concave and generally of U-shape seen from above. In addition the shell has a rim and the bag is secured to the shell at the rim.

DESCRIPTION OF THE DRAWING

The above and other features and advantages will become more readily apparent from the following, it being understood that any feature described with reference to one embodiment of the invention can be used where possible with the other embodiment. In the accompanying drawing.

SPECIFIC DESCRIPTION

Figure 1:
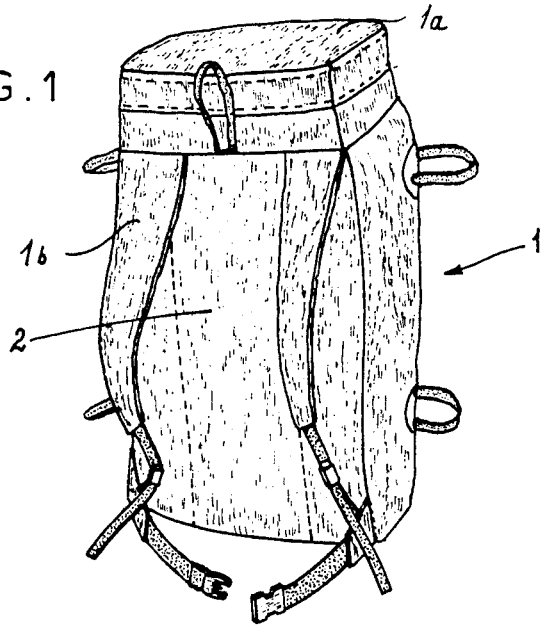
FIG. 1 is a small-scale perspective view from the front of a backpack according to this invention.
Figure 4:
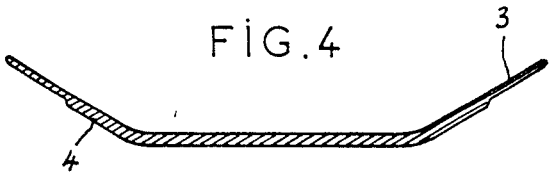
FIGS. 4 and 5 are sections taken respectively along lines IV—IV and V—V of FIG. 3.
Figure 5:
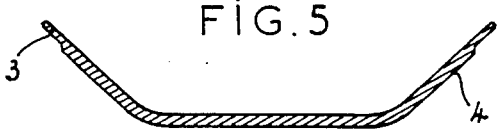
Figure 6:
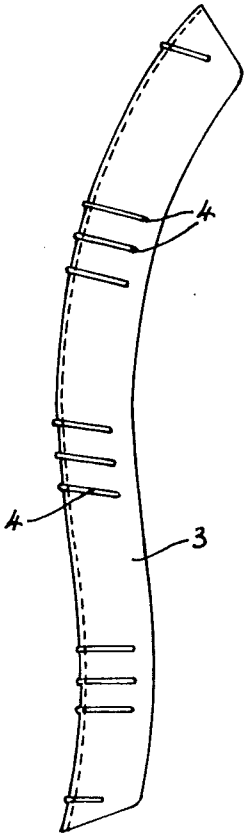
FIG. 6 is a view like FIG. 3 but showing the front panel when flexed longitudinally.
Figure 3:
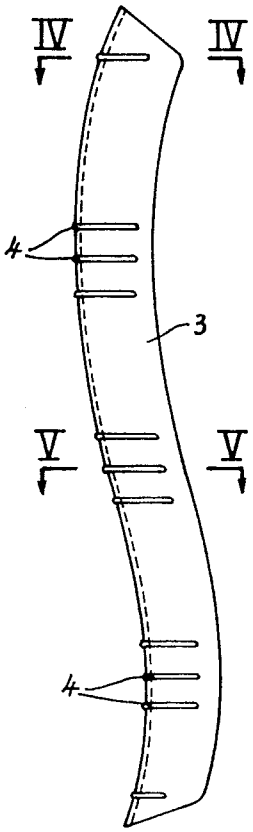
FIGS. 2 and 3 are back and side views of the reinforced front panel of the backpack of FIG. 1.
Figure 2:
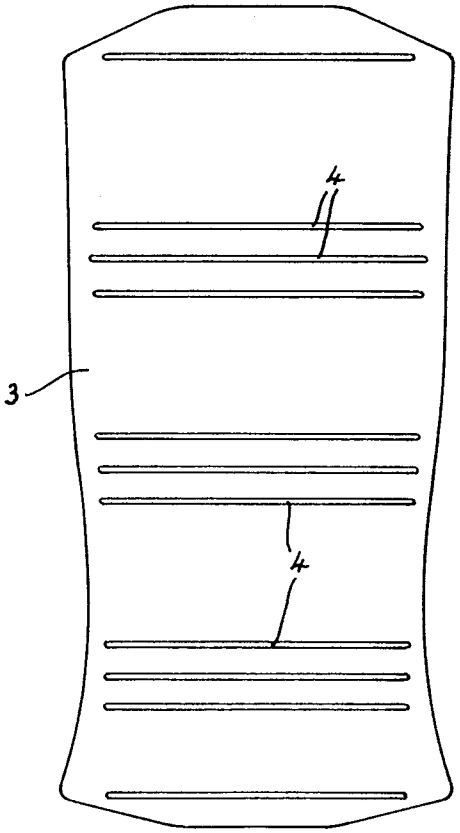

As seen in FIG. 1 a backpack according to this invention comprises a standard bag 1 provided with an openable top 1*a* and shoulder straps 1*b*, and has a front 2 that normally lies against the back of the wearer. According to this invention as seen in FIGS. 2 through 6 this front is provided with a forwardly concave panel 3 that is a semirigid synthetic-resin shell of U-section seen from above as in FIGS. 4 and 5 so that it conforms generally to the shape of the back of the user. This panel 3 is formed with transverse ribs 4 that stiffen it against bending transversely, that is becoming flatter or more U-shaped, but that permit it to bend longitudinally, that is as shown in FIGS. 3 and 6. Thus the wearer can bend forward and the panel 3 can flex, but otherwise the panel 3 will remain rigid and will have all the other advantages of a rigid pack.

Figure 7:
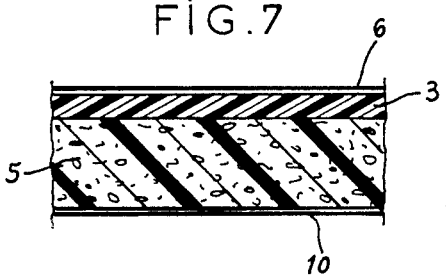
FIG. 7 is a large-scale section through a detail of the reinforced front panel.

The panel 3 can be made by molding of a single unitary piece of a synthetic resin. Alternately it can be made up of several pieces, so long as it has the desired longitudinal bendability and transverse rigidity. As shown in FIG. 7 this shell is formed by a thin sheet of a flexible synthetic resin that is formed with the horizontal ridges 4 so that it can readily flex parallel to these ridges 4. In addition its front face is provided with a layer 5 of a cellular synthetic resin and its rear face with a textile covering 6. Furthermore the front face of the soft layer 5 which contacts the back of the wearer can be provided with a textile covering 10.

Figure 8:
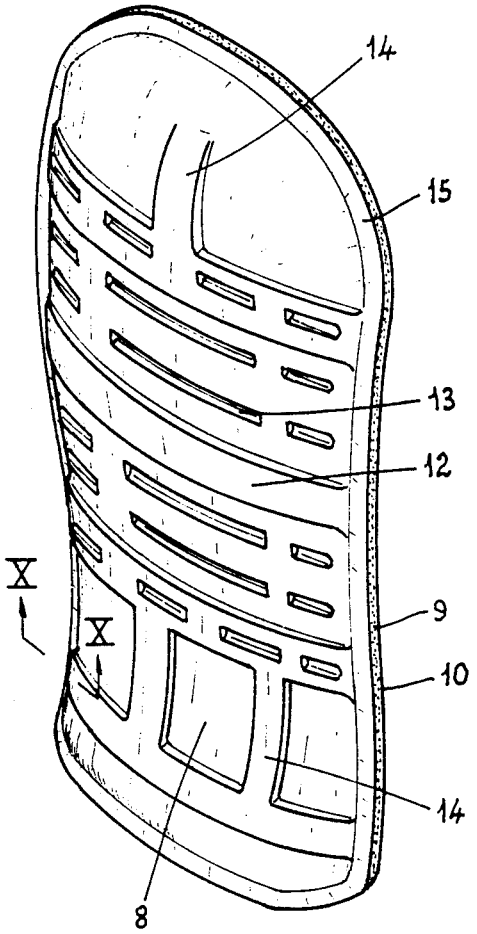
FIGS. 8 and 9 are back and front perspective views of another front panel according to this invention.
Figure 9:
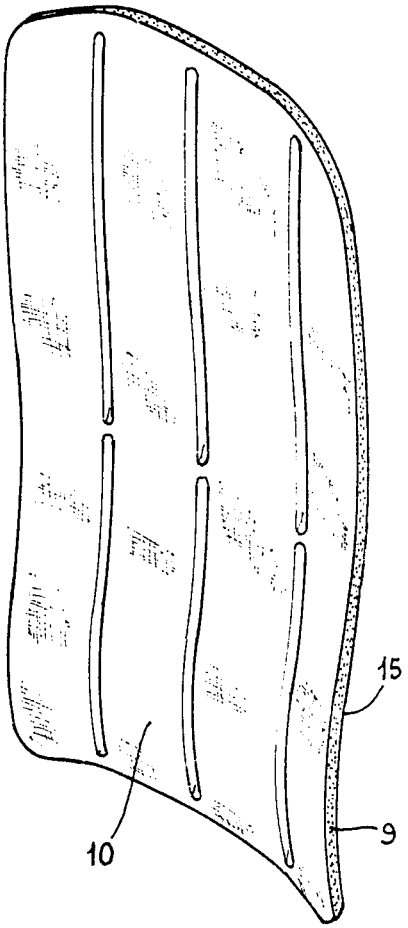
Figure 10:
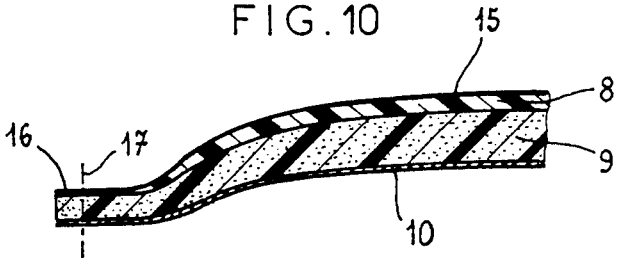
FIG. 10 is a large-scale section taken along line X—X of FIG. 8.

In the arrangement of FIGS. 8 through 10 the front 2 of the bag is formed by molding as a single unitary piece but is actually formed of three parts. Two layers 8 and 9 of a cellular synthetic resin are unitarily bonded together, with a textile jersey layer 10 on the soft front layer 8 and a hard skin 15 on the rear. The layer 8 is relatively dense, for instance being a polyurethane of a density of 300 kg/m$^3$. The layer 9 is softer and is for instance formed of a polyether having a density of 30 kg/m$^3$. The textile layer 10 is bonded to the arrangement by being provided in the mold before the layer 9 is cast or injected.

The layer 8 is made longitudinally flexible and transversely stiff by forming it with horizontal ridges 12 and grooves 13. The lower region and upper region of the reinforcement panel can have short vertical ridges 14 imparting modest longitudinal rigidity at these regions where the wearer's back cannot bend in any case. At its outer edge the reinforcement panel has a thin rim 16 which can be secured by stitching shown diagrammatically at 17 to the edges of the bag shown at 1 in FIG. 1.

I claim:

1. A backpack comprising:

a bag having a front and a back; and a vertically elongated shell at the front formed with transversely extending rigidifying formations, the shell being longitudinally relatively bendable and transversely relatively stiff, the shell also being forwardly concave and generally of U-shape seen from above so as to fit generally complementarily to a back of a wearer of the pack with the shell normally upright, the shell comprising a relatively rigid piece of high-density cellular synthetic resin extending the full vertical length of the shell and having a front face turned toward the back of the wearer, a layer of a relatively soft low-density cellular synthetic resin integrally bonded to and covering the entire front face, and a flexible textile covering overlying the soft resin layer.

2. The backpack defined in claim 1 wherein the formations are ridges or grooves.

3. The backpack defined in claim 1 wherein the shell has a rim and the bag is secured to the shell at the rim.

* * * * *